US006684823B1

(12) United States Patent
Plavnik et al.

(10) Patent No.: US 6,684,823 B1
(45) Date of Patent: Feb. 3, 2004

(54) IMPULSE ASH DEPOSIT REMOVAL SYSTEM AND METHOD

(75) Inventors: Zinovy Z. Plavnik, Atlanta, GA (US); Arun Mehta, Los Altos, CA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 10/412,359

(22) Filed: Apr. 11, 2003

(51) Int. Cl.[7] ..... F22B 37/48
(52) U.S. Cl. ..... 122/379; 122/396; 29/81.09
(58) Field of Search ..... 122/379, 396, 122/395, 24; 239/692; 29/81.01, 81.02, 81.06, 81.08, 81.09; 15/1.51, 404

(56) References Cited

U.S. PATENT DOCUMENTS

| | | | | | |
|---|---|---|---|---|---|
| 3,738,290 | A | | 6/1973 | Belter | |
| 4,368,677 | A | * | 1/1983 | Kline | 110/212 |
| 4,497,282 | A | | 2/1985 | Neundorfer | |
| 4,923,374 | A | * | 5/1990 | Lundin et al. | 417/440 |
| 4,926,798 | A | | 5/1990 | Kardos | |
| 4,959,009 | A | | 9/1990 | Hemsath | |
| 4,980,674 | A | * | 12/1990 | Scheibel et al. | 340/603 |
| 5,056,587 | A | | 10/1991 | Jones et al. | |
| 5,092,280 | A | * | 3/1992 | Franklin et al. | 122/379 |
| 5,123,835 | A | * | 6/1992 | Richards et al. | 431/1 |
| 5,176,513 | A | | 1/1993 | Zinn et al. | |
| 5,211,135 | A | | 5/1993 | Correia et al. | |
| 5,494,004 | A | * | 2/1996 | Hunter, Jr. | 122/395 |
| 5,769,034 | A | | 6/1998 | Zilka et al. | |
| 6,161,506 | A | | 12/2000 | Hanson | |
| 6,210,149 | B1 | | 4/2001 | Plavnik et al. | |

* cited by examiner

*Primary Examiner*—Gregory Wilson
(74) *Attorney, Agent, or Firm*—Gardner Groff, P.C.

(57) ABSTRACT

An impulse generator produces controlled pressure waves for removing ash deposits from heat exchangers in a boiler. The impulse generator has a fuel inlet, an air inlet, an ignitor, an outlet, and a control system for selectively and intermittently igniting the fuel and air to produce the pressure waves. In a first exemplary embodiment, the impulse generator includes a toroidal-shaped body with a tangential air inlet for inducing a helical swirling flow of the fuel and the air. In a second exemplary embodiment, the impulse generator includes a turbulizer with a corkscrew-shaped vane for inducing a helical swirling flow of the fuel and the air. In addition, an exemplary ash deposit removal method includes adjusting the fuel flow, airflow, ignition dwell time, and/or ignition interval time to selectively adjust the combustion mode between deflagrative and detonative combustion.

36 Claims, 12 Drawing Sheets

IMPULSE ASH DEPOSIT REMOVAL SYSTEM AND METHOD

TECHNICAL FIELD

The present invention relates to cleaning and removing ash deposits from boilers and, more particularly, to generating controllable pressure waves by intermittent combustion and directing the pressure waves at the ash deposits for removal.

BACKGROUND OF THE INVENTION

During the operation of fossil fuel-fired boilers, especially, coal-fired boilers, the combustion process produces ash. Large boilers used in power generation plants and other industrial and commercial applications can produce especially large amounts of ash. The ash builds up on the heat exchanger tubes inside the boiler, which significantly reduces the heat transfer to the tubes and the thermal efficiency of the boiler. To maintain the desired efficiency of the boilers, boiler designers often install soot blowers which use media such as air or steam to clean specific areas of the boilers. However, in order to remove hard-to-clean deposits and/or deposits from not easily accessible areas of the boilers, operators often have to lower the load or capacity of the boiler and sometimes shut down the boiler. For example, electric utility companies sometimes schedule lowering of loads (derating) every night and/or schedule shutting down the boiler completely every few months or so, each shutdown typically lasting for a couple of days or so, to remove the ash deposits that have built up since the last shutdown. During the periods of derating, and shutdown of the boiler, the lost amount of electricity has to be purchased or obtained from other sources usually at higher prices.

A number of techniques have been developed to remove ash deposits from boilers. One technique involves using retractable water, steam, or air jet equipment to attempt to spray and remove the ash deposits off of the heat exchanger tubes. The thermal shock of the cooler water or other media can produce thermal stresses on the very hot metal heat exchanger tubes resulting in potential cracking and failures, and additional shutdowns for repairs. Another technique involves using shotguns, dynamite, or other explosives to attempt to jar the ash loose from the heat exchangers. But this technique can potentially damage the boiler and further, the boiler has to be shut down to insert the dynamite. And in yet another known technique, compressed air acoustic generators and pulse combustors are used to set up a standing acoustic wave to attempt to jolt the ash off the heat exchangers. But this approach has limited effectiveness because sound waves dissipate quickly and the loudness and frequencies needed to effectively remove the ash are harmful or at least very aggravating to the human ear.

Accordingly, what is needed but not found in the prior art is a way to remove ash deposits from boilers in order to maintain a high availability and high thermal efficiency. In particular, there is a need for a system and method for removing the existing ash deposits while the boiler is being operated and for not allowing ash deposits to build up excessively any further on the heat exchangers, and thus minimizing any derating and loss of availability of the boiler. Furthermore, there is a need for such a system and method that is time- and cost-effective to build, install, operate, and maintain. It is to the provision of such an ash deposit removal system and method that the present invention is primarily directed.

SUMMARY OF THE INVENTION

The present invention is an impulse system for removing deposits such as ash from heat exchangers or other surfaces in a boiler or other apparatus. Generally described, the impulse system includes at least one impulse generator and a control system operably connected to the impulse generator. The impulse generator has a hollow body and an ignitor. The hollow body has an inlet for air, an inlet for fuel, and an outlet for ignited air and fuel, with the outlet connected to the boiler. The control system is operable to activate the ignitor to ignite the air and fuel in the impulse generator body. The ignition of the air/fuel produces a pressure wave that is directed through the outlet and into the boiler to remove the ash deposits.

The control system includes conventional control components such as a programmable logic controller connected to input sensors and output components. For example, the input sensors may include pressure, temperature, and flow sensors, and the output components may include control valves and ignition timing controls. In this way, the control system is operable to monitor and precisely control the combustion process to generate desired pressure oscillations and the resulting pressure waves.

Preferably, the control system is operable to adjust the fuel flow, air flow, ignition dwell time (duration of spark), or ignition interval time (time between sparks), or a combination of these. In this way, the impulse generator can be controlled to produce high-pressure detonative combustion, intermediate-pressure deflagrative combustion, low-pressure pulse combustion, or a combustion process in the transition zones between these. The preferred combustion mode is a function of the properties of the deposit to be removed. So the control system permits adjusting the combustion mode to match the most efficient or effective mode for the deposit that is present.

In addition, the impulse generator is preferably configured to induce a helical swirling flow of the fuel and the air. This enhances air/fuel mixing for a more complete and uniform combustion, which is more fuel-efficient and controllable.

In a first exemplary embodiment of the present invention, the impulse generator hollow body is generally toroidal-shaped, forming a looped air and fuel flow path. The air inlet is preferably generally tangential to a plan view flow path centerline of the body. This induces the fuel and the air to flow in a loop around and around within the body. In addition, the air inlet is preferably generally tangential to a side view cross section of the body for inducing the helical swirling flow of the fuel and the air in the body.

The outlet is positioned to discourage the helically swirling air and fuel from leaking into the boiler before it is ignited. For example, the outlet can be perpendicular to a side view centerline of the impulse generator body and flared. In this way, the helically swirling air and fuel will tend to flow past the outlet and continue flowing around in the impulse generator body until ignited by an ignition source.

In alternatives to the first embodiment, the body is spiral-shaped, has a 270 degree turn, has a combined air/fuel inlet for use with a pre-mixer, has an acutely angled air inlet for further inducing the helical swirling flow, has a tangential outlet in an opposite direction from the helically swirling air/fuel, and/or has a corkscrew-shaped vane. Those skilled in the art will understand that other alternative embodiments can be used to accomplish the desired ash deposit removal.

In a second exemplary embodiment of the present invention, the impulse generator includes a turbulizer including at least one vane for inducing the helical swirling flow of the fuel and air. For example, the vane can be generally corkscrew-shaped and positioned in the impulse generator body. And the fuel inlet conduit can be extended into the body, provided with fuel apertures, and have the vane formed on it. In this way, the fuel flows through the fuel conduit and out through the apertures so that it is dispersed evenly into the body where it is induced into the helical swirling motion with the air as they flow along the vane. Preferably, the hollow body is generally cylindrical and the fuel conduit and air conduit are coaxially arranged.

In a third exemplary embodiment of the present invention, the impulse generator includes a turbulizer with at least one vane configured for use with a combined air/fuel inlet and, preferably, a pre-mixer. In this embodiment, the shape, size, number, and spacing of the vane ridges, as well as the position of the ignitor, can be modified from the second embodiment in order to induce continuation of the helical swirling flow of the fuel and air after ignition.

Additionally, the present invention provides an exemplary method for removing ash or other deposits from a boiler or other apparatus. The method includes the steps of providing at least one impulse generator in communication with the boiler, introducing air and fuel into the impulse generator, and igniting the air and fuel to produce pressure waves that are transmitted from the impulse generator into the boiler to remove the ash deposits from the boiler.

The method preferably includes the steps of inducing a helical swirling flow of the fuel and the air in the impulse generator. This can be facilitated by providing the impulse generator with a toroidal-shaped body similar to that of the first embodiment, a turbulizer with at least one cork-screw-shaped vane similar to those of the second or third embodiment, or a combination of these.

In addition, the ash deposit removal method preferably includes a combustion mode adjustment process. This adjustment method includes the step of selecting a combustion mode based on certain properties of the ash deposit. Such properties may include the distance of the deposit from the impulse generator outlet, whether the deposit is encrusted or fused to the surface to be cleaned, the weight and density of the deposits, etc. Different combustion modes are desirable for removing different types of these deposits. Different combustion modes include, for example, detonative combustion for generating a higher pressure, deflagrative combustion for generating an intermediate pressure, and pulse combustion for generating a lower pressure.

The adjustment method further includes the step of adjusting the control system for the impulse generator to produce the selected combustion mode. This adjustment can be made by adjusting the fuel flow, air flow, ignition dwell time, ignition interval time, or a combination of these. By selectively controlling the combustion mode of the impulse generator in this way, the impulse system can be operated most efficiently and effectively to maximize the operational efficiency of the boiler.

In view of the foregoing, it will be appreciated that the present invention provides for removing ash deposits from heat exchangers in a boiler while it is running. So the boiler does not need to be shut down for the cleaning and ash deposits do not build up so much. In this way, the boiler is kept in much better operating condition and operates at a consistent and relatively high thermal efficiency. Furthermore, the present invention is time- and cost-effective to implement.

The specific techniques and structures employed by the invention to improve over the drawbacks of the prior systems and accomplish the advantages described above will become apparent from the following detailed description of the embodiments of the invention and the appended drawings and claims.

DETAILED DESCRIPTION OF THE EXEMPLARY EMBODIMENTS

Figure 1:
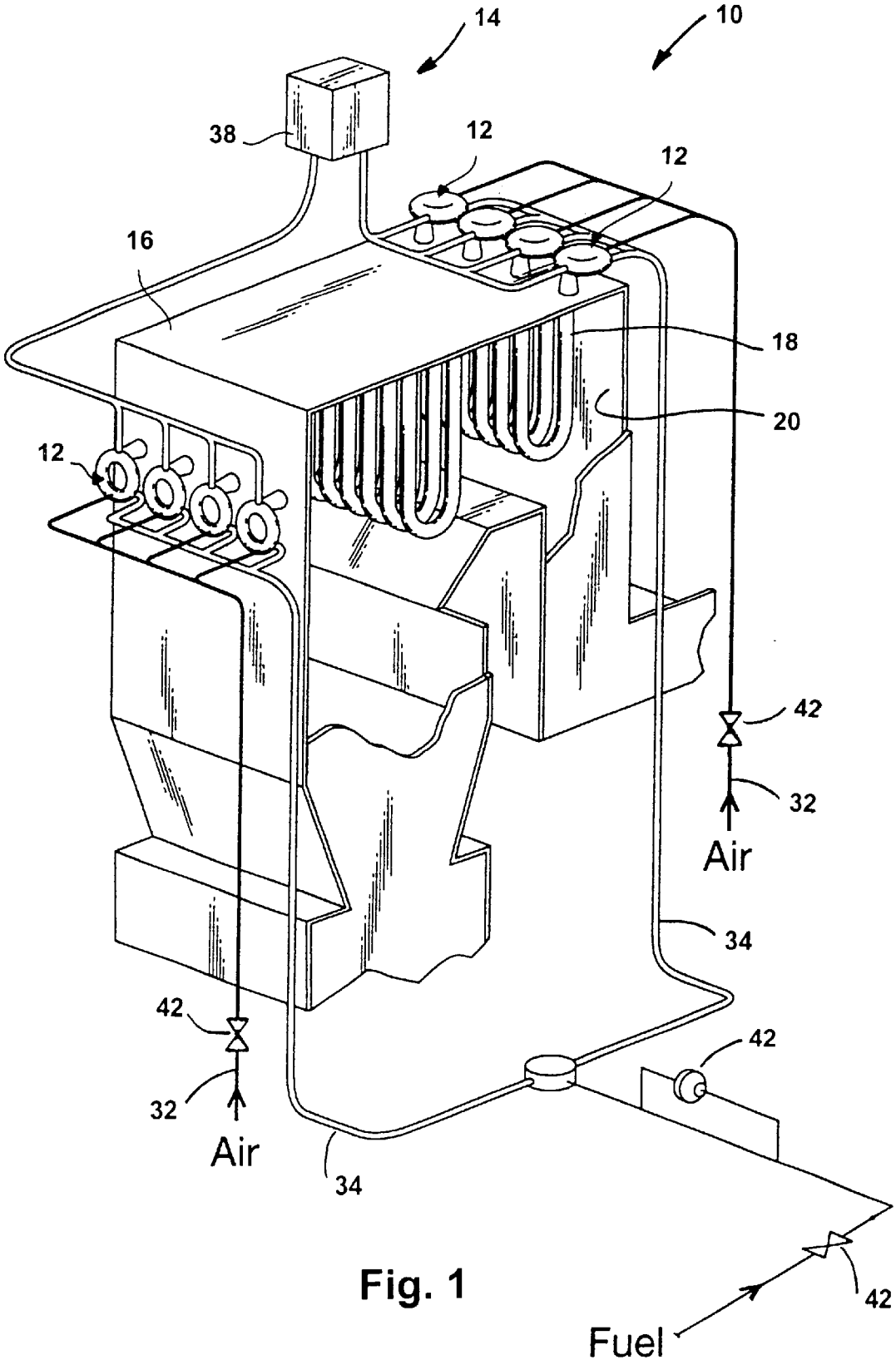
FIG. 1 is a perspective view of a first exemplary embodiment according to the present invention, showing a plurality of impulse generators connected to a boiler and a control system operably connected to the impulse generators.

Referring now to FIGS. 1–6, a first exemplary embodiment of the present invention provides an ash deposit removal system, generally referred to as the system 10. As shown in FIG. 1, the system 10 includes one or more impulse generators 12 and a control system 14 for operating the impulse generators 12. The impulse generators 12 combust fuel and air to generate impulse pressure waves and use them to remove ash deposits from surfaces in boilers 16 such as heat exchangers 18 and inner walls 20. The system 10 can be used for cleaning any type of surface, whether flat or having surface features, including heat exchangers with coils, fins, and/or other heat transfer surfaces. And the system 10 can be adapted for removing other types of deposits in applications other than boilers.

A number of the generators 12 can be mounted on one boiler 16 and controlled together. The number and configuration of the generators 12 is selected based on the position, size, and shape of the heat exchangers 18 or other target surface to be cleaned. For example, one set of generators 12 can be oriented at one angle to the heat exchangers 18 and another set of generators can be oriented at another angle or position relative to the heat exchangers. In this way, the entire surface of the heat exchangers 18 can be maintained free of ash build-up.

As shown in FIGS. 2–6, each impulse generator 12 has a body 22, an air inlet 24, a fuel inlet 26, an ignitor 28, and an outlet 30. The outlet conduit 30 is attached to the boiler 16 by conventional fasteners such as bolts, welding, or another technique known in the art.

Figure 5:
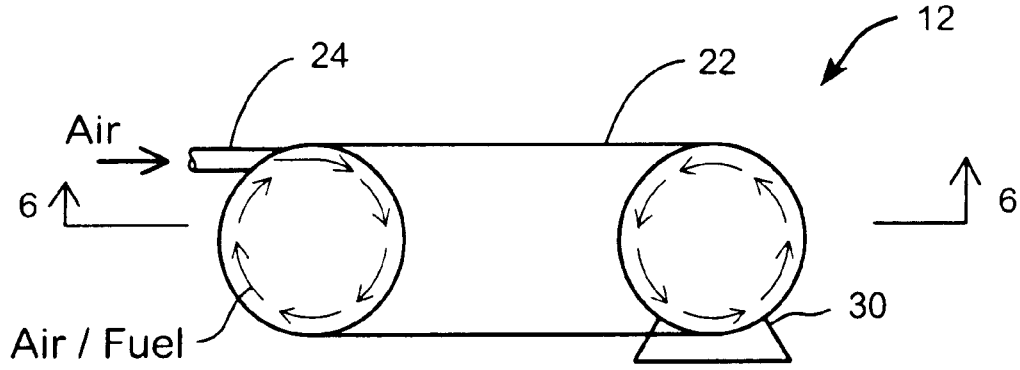
FIG. 5 is a cross sectional side view of the impulse generator of FIG. 3, showing a tangential air inlet and a resulting helical swirling flow of air and fuel.
Figure 6:
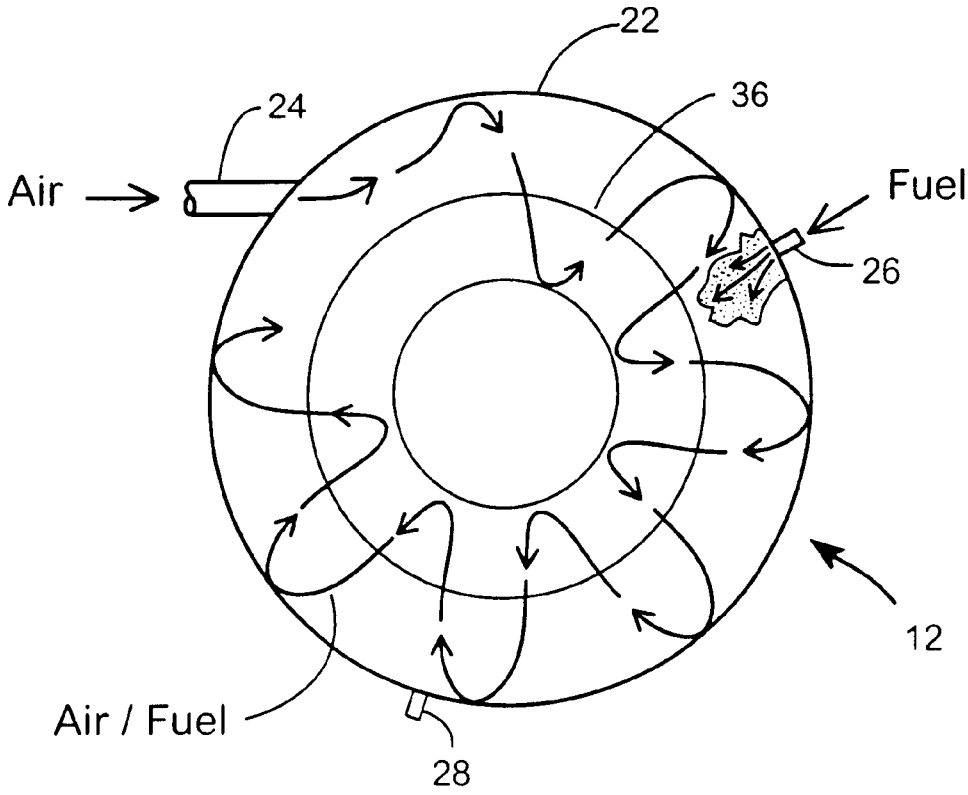
FIG. 6 is a cross sectional plan view of the impulse generator taken a line 6—6 of FIG. 5, showing the tangential air inlet and the helical swirling flow of air and fuel.

The body 22 forms a looped flow path for air and fuel and facilitates a helical swirling flow of the air and fuel (see FIGS. 5 and 6). For example, the body 22 can be generally toroidal in shape. In this way, the air and fuel are more thoroughly mixed so that when the mixture is ignited large amplitude pressure waves (i.e., pressure oscillations) are produced and propagated. In a typical commercial embodiment, the body 22 is constructed of two 180-degree turns connected together by bolts, welding, or another technique. For example, the 180-degree turns can be made of schedule 40 carbon steel, have a plan view diameter of 2 feet 8 inches, and have a side view cross section diameter of 8 inches.

It will be understood that "generally toroidal" includes shapes other than a perfect toroid, such as body shapes with a side view cross-sectional shape or a plan view shape that is oval or teardrop-shaped. And "generally toroidal" includes shapes other than that of a single toroid, such as a body with two toroidal segments connected in the shape of a figure "8" or with three or four toroidal segments connected in the shape a cloverleaf.

The air inlet 24 is at the end of an air conduit 32 for supplying air to the impulse generator 12 for combustion. The air is delivered continuously to the generator 12, with the flow volume rate controlled by an air control valve. To help control the flow of air, it can be forced into the generator 12 by a fan, blower, or the like. In order to induce the helical swirling flow of the air (and the fuel) in an organized fashion, the air inlet 24 is positioned generally tangential relative to a curved surface of the body 22. For example, the air inlet 24 can be attached generally tangentially to a side view cross section of the body (see FIG. 5). In addition, in order to induce the air (and fuel) to flow around the body 22 in a loop in an organized fashion, the air inlet 24 can be attached generally tangentially to a plan view flow path centerline 36 of the body (see FIG. 6). As used herein, generally tangentially means not just exactly tangential but also angled slightly from tangential (for example, see FIG. 9) as long as the indicated flow is still achieved. Of course, in applications where the helical swirling flow is not needed, the air inlet 24 can be suitably attached to the body 22 in other non-tangential configurations.

The fuel inlet 26 is at the end of a fuel line 34 for supplying the fuel to the impulse generator 12 for combustion. The generator 12 can be operated using a variety of fuels, such as pressurized natural gas, propane, etc. The fuel is delivered continuously to the generator 12, with the flow volume rate controlled by a fuel control valve.

The ignitor 28 is provided by a spark plug, pilot burner, or other conventional ignition device. Preferably, the ignitor 28 is positioned in the looped flow path within the impulse generator body 22 after the air inlet 24 and the fuel inlet 26. For convenience, the ignition may be referred to as "spark". The ignitor 28 is controlled to provide sparks to ignite the fuel and air in the body 22, as described below. Preferably, the amplitude of the sparks is constant.

The outlet 30 is provided by a conduit for exhausting the combustion gases from the impulse generator body 22 into the boiler 16. The outlet conduit 30 is attached to the boiler 16 by a bolted flanged connection or another attachment means. An opening can be cut or otherwise formed in the boiler 16 where the outlet conduit 30 is to be attached, or the outlet conduit can be attached to the boiler at an existing opening in the boiler such as an access or observation port.

The attachment of the outlet conduit 30 to the boiler 16 is at a position selected for directing the impulse pressure wave from the hot expanding combustion gases at heat exchangers 18 or other targeted surfaces in the boiler. The outlet 30 can be flared, either outwardly/divergently (see FIG. 4) for directing the pressure waves broadly at the heat exchangers, or inwardly/convergently for focusing the pressure waves narrowly at specific targets.

Figure 4:
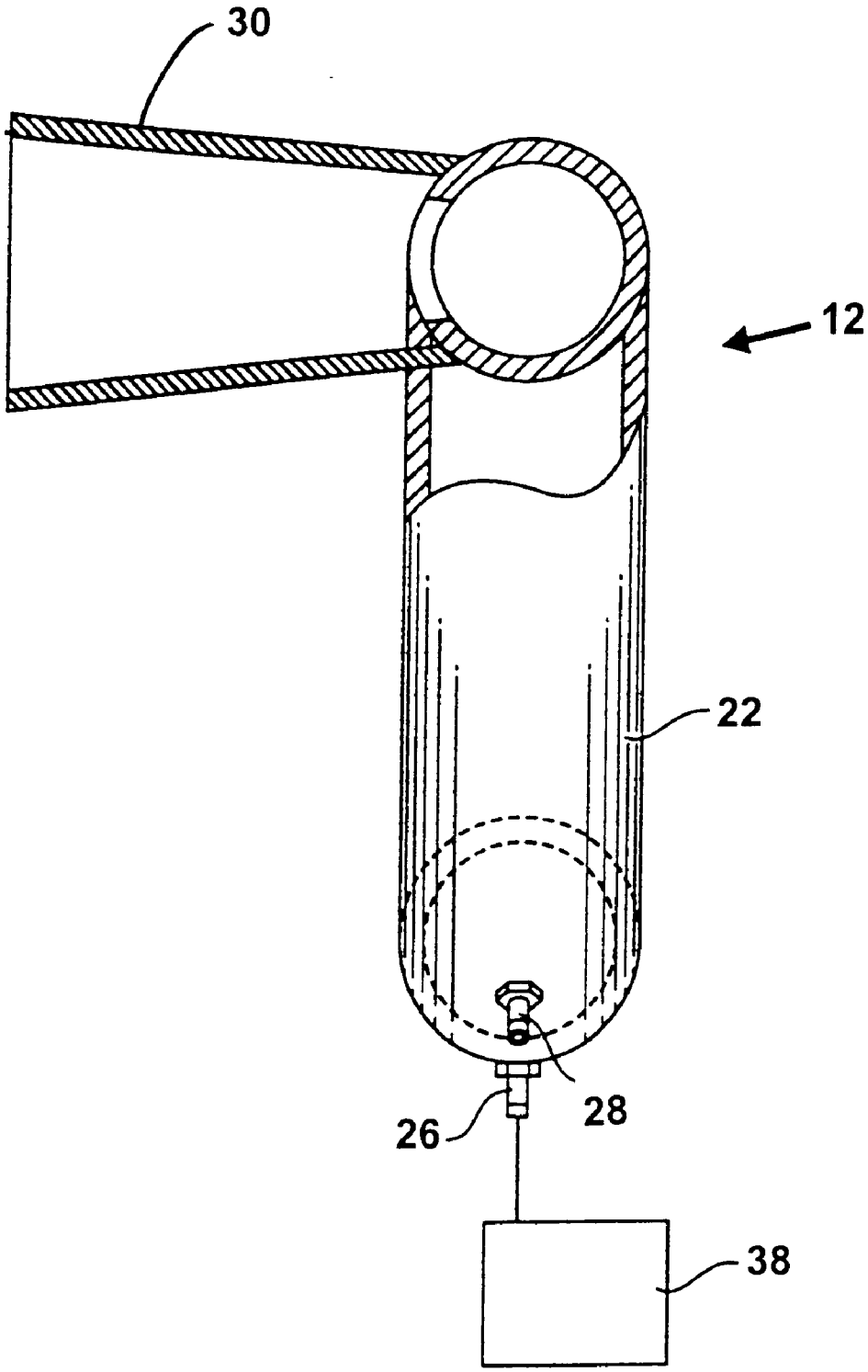
FIG. 4 is a side view of the impulse generator of FIG. 3 with a portion cut away to show the outlet in cross section.

Preferably, the outlet conduit 30 is positioned generally perpendicular to the impulse generator body 22 in a side view (see FIG. 4). In this configuration, the helical swirling flow of air and fuel experiences not just centrifugal force, so most of it continues flowing around past the outlet 30 instead of leaking into the boiler 16. Thus, the outlet 30 does not need a valve to control the outflow from the body 22, and most of the fuel/air mixture continues flowing around and around the looped flow path in the body 22 until it is ignited. When the fuel/air mixture completes the looped flow path and encounters additional fuel and air just entering the body 22, this generates turbulence and enhances fuel/air mixing.

In this way, the fuel and air are thoroughly mixed in the impulse generator body 22 with little fuel/air leakage into the boiler 16. When the mixed air/fuel is ignited, it expands very rapidly so that most to practically all of the combustion products are forced out of the body 22 and into the boiler 16. The rapidly expanding combustion gases in the impulse generator 12 generate high amplitude pressure waves. The pressure waves are aimed at the ash deposits causing them to be broken loose from the heat exchangers 18 in the boiler 16. When the impulse generator 12 is operated frequently ash deposits are prevented from building up on the heat exchangers 18, and when the impulse generator is operated less frequently any built-up ash deposits are removed. By minimizing ash build-up, the boiler 16 operates more efficiently.

The operation of the impulse generator 12 is controlled by the control system 14. The control system 14 includes a programmed logic controller 38, input sensors 40, and output components 42. The particular components and their configuration and operation are described in detail below.

Figure 7:
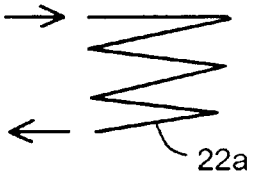
FIG. 7 is a side view of an impulse generator body according to an alternative first embodiment, showing a helical-shaped body.
Figure 8:
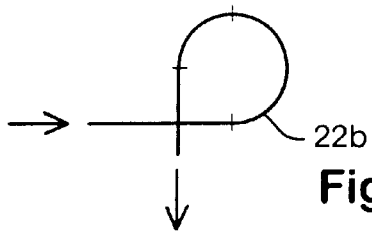
FIG. 8 is a plan view of an impulse generator body according to another alternative first embodiment, showing a 270-degree body.

FIGS. 7–12 show several alternatives to the impulse generator of the first embodiment. The impulse generator body can be provided with other shapes that facilitate a helical swirling flow of the air and fuel and/or that provide a looped flow path for air and fuel. For example, FIG. 7 shows a helical tubular body 22*a* forming a continuous flow path, which enhances mixing but does not provide a looped flow path (because the fuel/air can not make more than one loop through the body). In such a non-looped flow configuration, the adjustment of the ignition is more limited because the fuel and air must be ignited before it flows out of the body. FIG. 8 shows a 270-degree body 22*b* made with a 180-degree turn and a 90-degree turn for enhancing mixing but not providing a looped flow path. In this embodiment, the body 22*b* may need to be sized larger to achieve the desired mixing or ignition dwell and/or interval times. And in still other alternative embodiments configured for inducing a helical swirling flow of the air and fuel, the impulse generator body is U-shaped or S-shaped.

Figure 9:
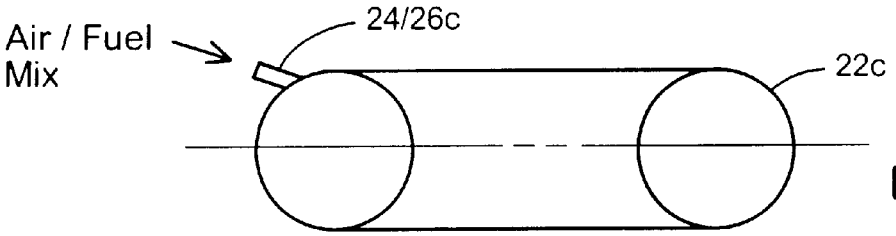
FIG. 9 is a side view of an impulse generator body according to another alternative first embodiment, showing a combined air/fuel inlet.

FIG. 9 shows an alternative impulse generator body 22*c* with the air inlet and the fuel inlet provided by a combined air/fuel inlet 24/26*c*. In such an embodiment, the air and fuel are supplied together in one line to the body 22*c*. An air/fuel pre-mixer can be provided in line with the air/fuel inlet 24/26*c* so that the air and fuel arrive in the body 22*c* sufficiently mixed for controlled combustion. For some applications, for example, where short ignition time intervals are desired and/or with non-looped flow path body configurations, the pre-mixer is preferred. In other applications, the air/fuel pre-mixer does not need to be provided.

Figure 10:
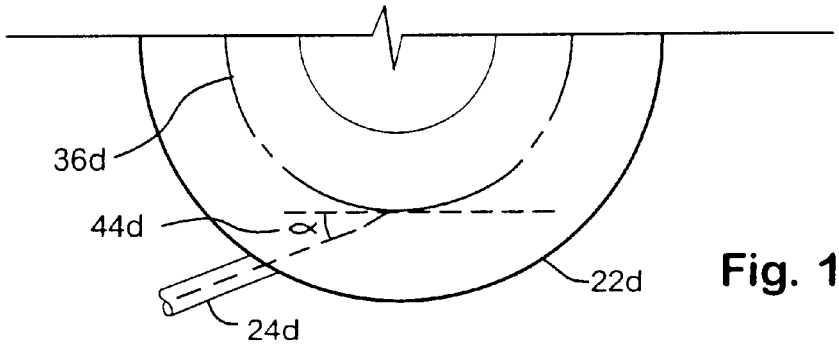
FIG. 10 is a partial plan view of an impulse generator body according to another alternative first embodiment, showing an acutely angled air inlet.

FIG. 10 shows an alternative impulse generator body 22*d* with the air inlet 24*d* at an acute angle 44*d* to the plan view flow path centerline (that is, to its tangent line). In this configuration, the inlet angle 44*d* is selected to induce a desired frequency and/or organization of the helical swirling flow.

Figure 11:
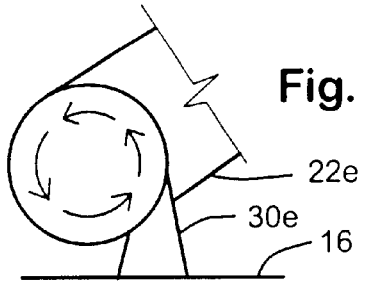
FIG. 11 is a partial side view of an impulse generator body according to another alternative first embodiment, showing a tangential outlet.

FIG. 11 shows an alternative impulse generator body 22*e* with the outlet 30*e* generally tangential to the side view cross section of the body. In this configuration, the outlet 30*e* is generally tangential in an opposite direction of the helical swirling flow, so the fuel/air is less likely to leak into the boiler and instead continues around and around in a loop in the body 22*e*. Alternatively, the outlet can be positioned generally tangentially to the body in the same direction as the helical swirling flow so that the flow is encouraged to exit the body, and the fuel/air ignited before completing the loop. In this configuration, the body may need to be sized larger to achieve the desired mixing or ignition dwell and/or interval times.

Figure 12:
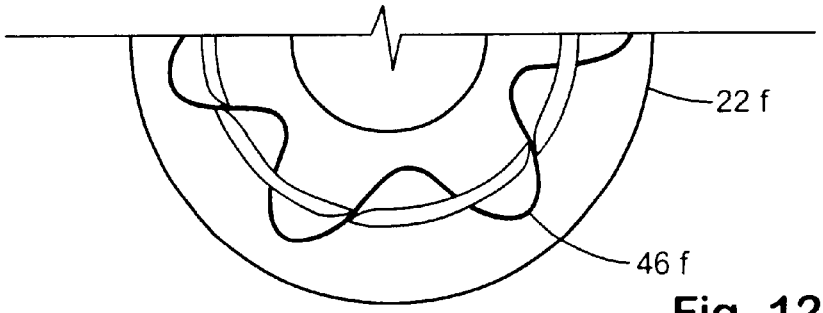
FIG. 12 is a partial plan view of an impulse generator body according to another alternative first embodiment, showing a corkscrew-shaped vane.

And the alternative embodiment shown in FIG. 12 depicts the impulse generator body 22*f* having a vane 46*f* positioned within it for inducing the helical swirling flow of fuel and air. The vane 46*f* can be corkscrew-shaped, as shown, or it can be otherwise configured. For example, the vane can include helical inner wall segments and helical outer wall segments in a staggered configuration, each extending towards and overlapping the center of the flow path.

Figure 13:
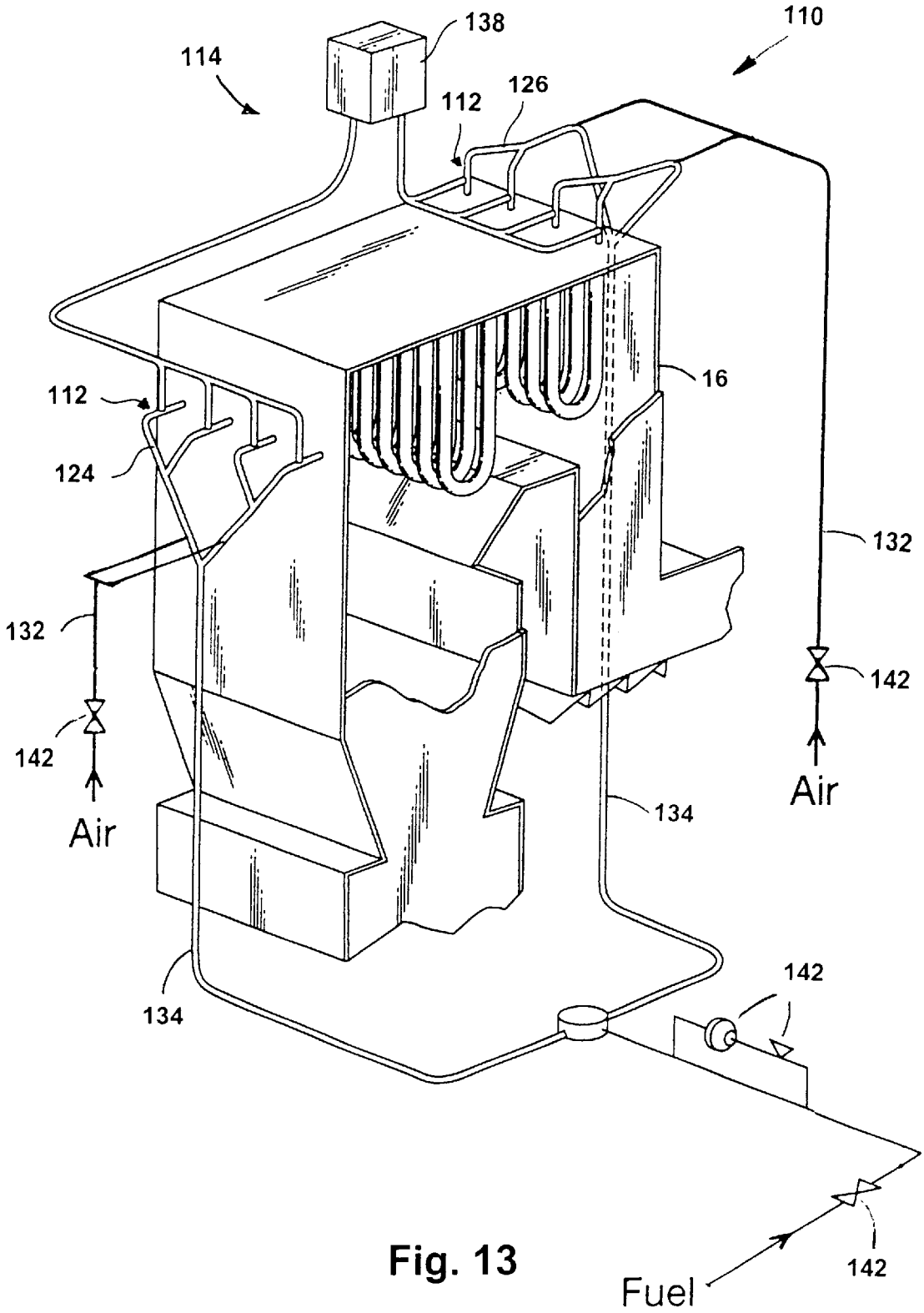
FIG. 13 is a perspective view of a second exemplary embodiment according to the present invention, showing a plurality of impulse generators connected to a boiler and a control system operably connected to the impulse generators.
Figure 14:
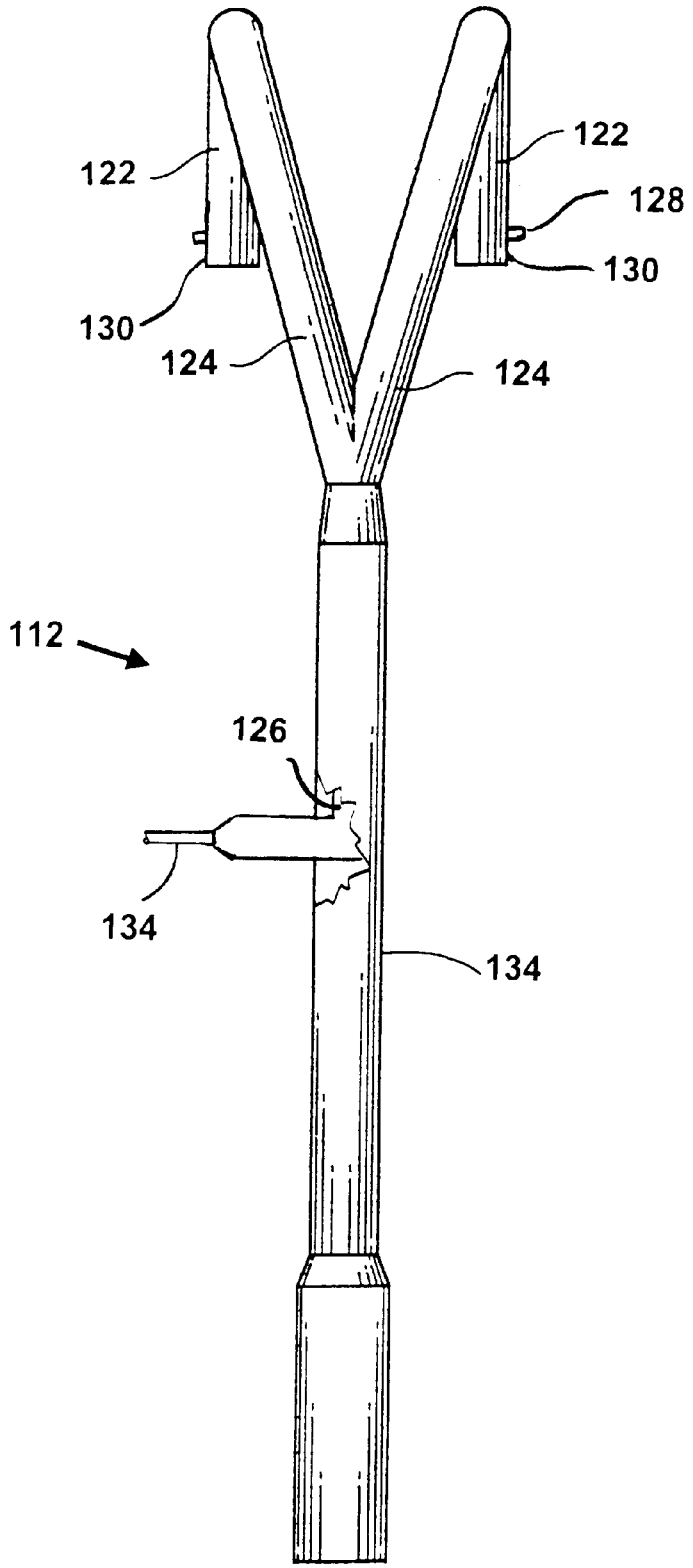
FIG. 14 is a plan view of one of the impulse generators of FIG. 13.
Figure 15:
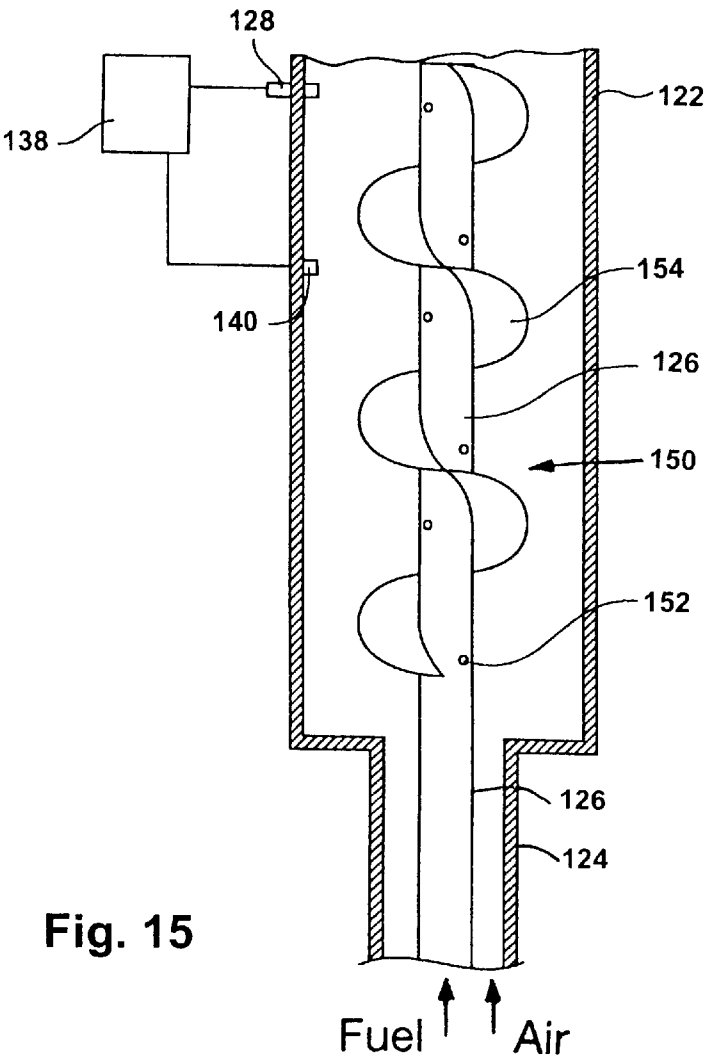
FIG. 15 is a cross-sectional view of one of the impulse generators of FIG. 14, showing a body with an air inlet, a fuel inlet, an ignitor, and an outlet, and a turbulizer with a corkscrew-shaped vane.

Referring now to FIGS. 13–15, there is shown a second exemplary embodiment of the invention, generally referred to as the ash deposit removal system 110. The system 110 includes a control system 114 that is similar to that of the first embodiment, including controller 138, sensors 140, and output components 142, but a different impulse generator 112.

As best shown in FIGS. 14 and 15, in the second embodiment the impulse generator 112 includes a hollow body 122 with an air inlet 124, a fuel inlet 126, an ignitor 128, and an ignited air/fuel outlet 130 connected to the boiler 16. The air and fuel supply lines 132 and 134 are connected to the hollow body 122, which for convenience may be provided by a line shaped and sized similarly to the air and/or lines. For example, each hollow body 122 can be generally cylindrically shaped and each hollow body and air inlet 124 can be provided by a single length of pipe. In addition, the fuel inlet 126 and the air inlet 124 are preferably coaxial where they enter the body 122, as best shown in FIG. 15.

Within each body 122 is a turbulizer 150 for inducing the helical swirling flow to mix of the fuel and air without the need for a pre-mixer. The turbulizer 150 includes a portion of the fuel inlet conduit 126 extending into the body 122 with one or more apertures 152 in it. In addition, the turbulizer 150 includes at least one generally corkscrew-shaped vane 154 extending from the fuel inlet conduit 126 in the body 122.

In operation, the fuel flows through the fuel inlet conduit 126, out through the apertures 152, and into the body 122. The air flows into the body 122 through the air inlet 124 around the fuel inlet 126, and the vane 154 induces the fuel and air to flow around it in a helical swirling pattern. This action thoroughly and uniformly mixes the fuel and air so that it can be combusted in the body 122 in a more controlled and complete fashion. And after the fuel and air are ignited, the vane 154 induces the burning fuel/air mixture to continue the helical swirling pattern.

In alternative embodiments, the cross-section of the body has another geometric shape, including square, triangular, polygonal, or another regular or irregular shape. In other alternative embodiments, the vane includes segments extending inward from the inner wall of the body, a series of fan blades spaced along the fuel inlet conduit, and/or another size, shape, and frequency of ridges. In still other alternative embodiments, the apertured conduit delivers the air into the body, alternatively or in addition to delivering the fuel. And in yet other alternative embodiments, the body has multiple outlets and/or one turbulizer feeds multiple bodies (the turbulizer is inline before the bodies instead of within them).

Figure 16:
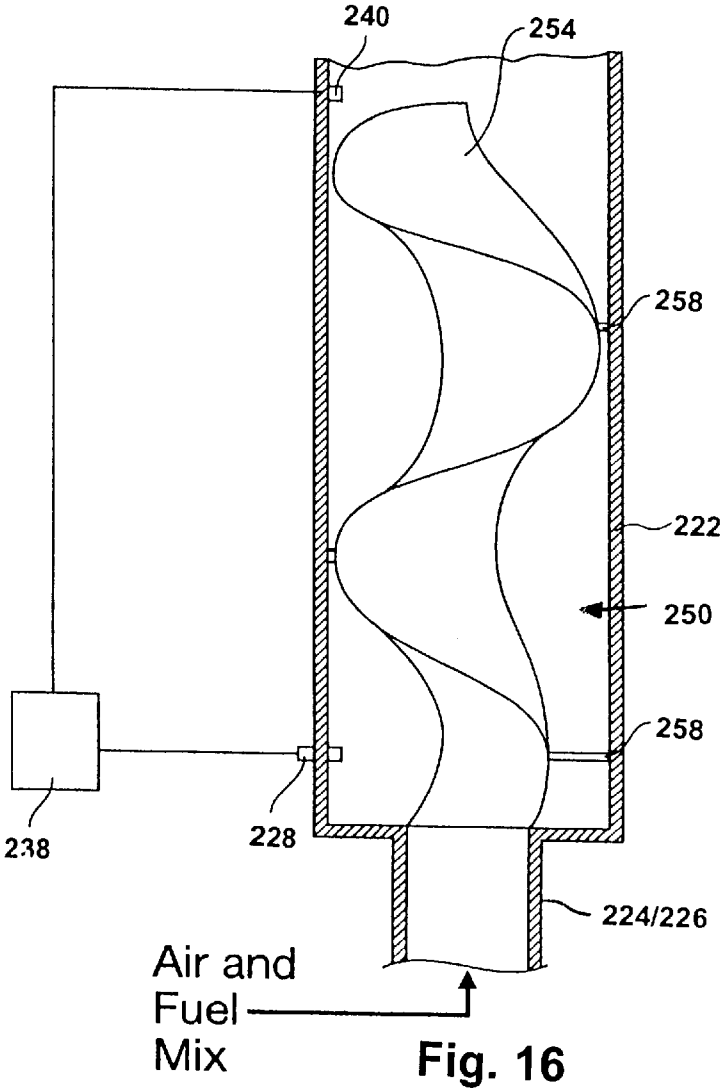
FIG. 16 is a cross-sectional view of a portion of a third exemplary embodiment according to the present invention, showing an impulse generator having a body with an air inlet, a fuel inlet, an ignitor, and an outlet, and a turbulizer with a corkscrew-shaped vane for use with a pre-mixer.
Figure 17:
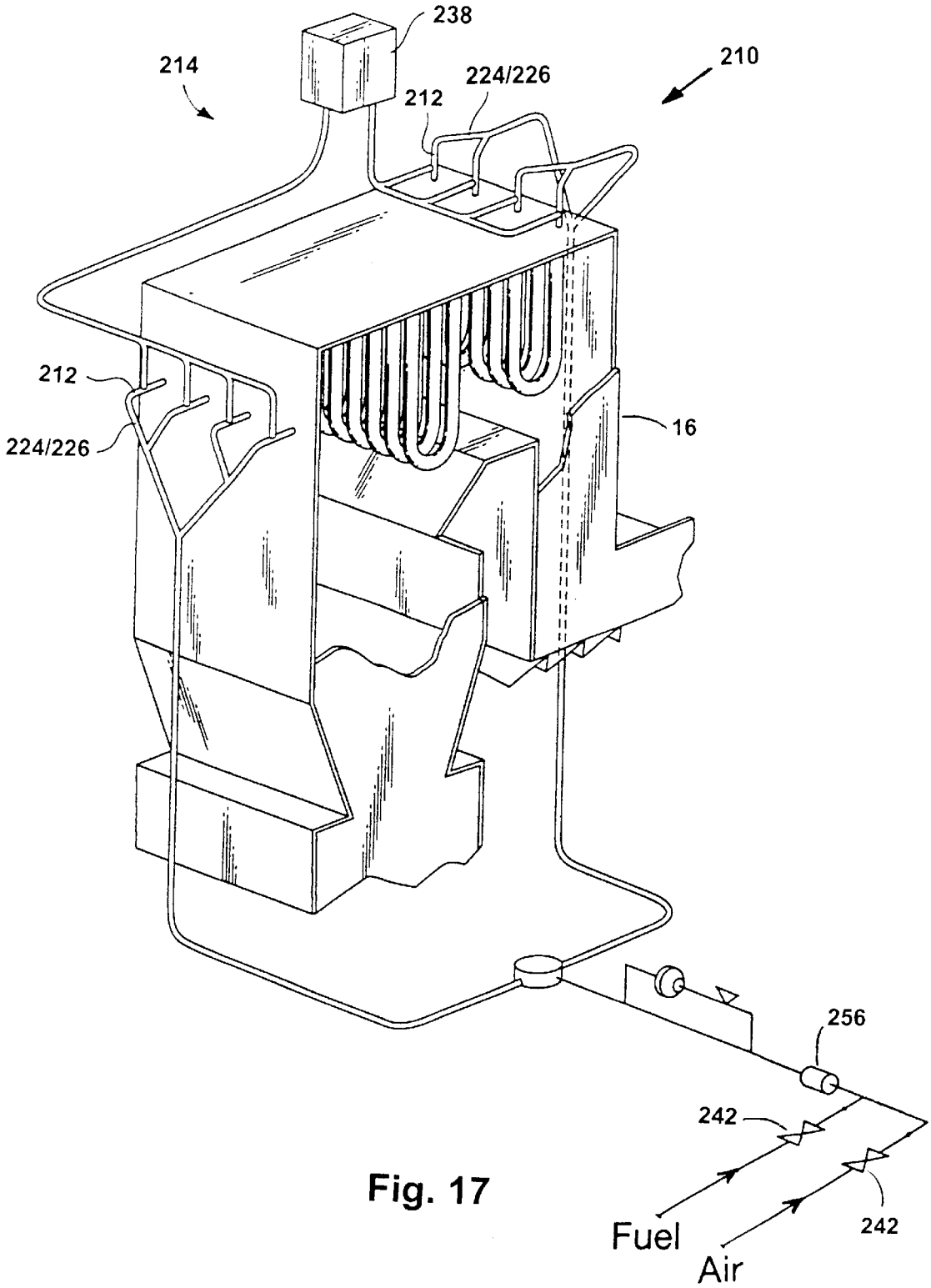
FIG. 17 is a perspective view of a plurality of the impulse generators of FIG. 16 connected to a boiler and a control system operably connected to the impulse generators.

Referring now to FIGS. 16–17, there is shown a third exemplary embodiment of the invention, generally referred to as the ash deposit removal system 210. The system 210 includes a control system 214 that is similar to that of the second embodiment, including controller 238, input sensors 240, and output components 242, but a different impulse generator 212. The impulse generator 212 has a hollow body 222 with a combined air/fuel inlet 224/226, an ignitor 228, and an ignited fuel/air outlet 230 connected to the boiler 16.

In the third embodiment, the system 210 includes a pre-mixer 256 for the air and fuel so that they are sufficiently mixed upon entering the body 222. The turbulizer 250 includes at least one corkscrew-shaped vane 254 extending into the body 222 to induce the burning air/fuel mixture into the helical swirling pattern. The vane 254 is held within the body 222 by supports 258 connected to the inner walls of the body 222. The supports 258 can be provided by rods or other structures for securing the vane 254 in place.

The ignitor 228 can be positioned closer to the air/fuel inlet 224/226 or farther from it, depending on whether any additional air/fuel mixing is desired before ignition. That is, the ignitor 228 can be positioned closer to the inlet 224/226 when no additional air/fuel mixing is desired, as shown in FIG. 16 relative to FIG. 15. In addition, the vane 254 can be selected with the size, shape, and frequency of its ridges selected based on whether any additional mixing is desired. That is, the vane 254 can be provided with a lower frequency (i.e., greater spacing) of ridges when no additional fuel/air mixing is desired, as shown in FIG. 16 relative to FIG. 15. And in some applications it may be desired to conduct most all of the mixing in the body 222, in which case the pre-mixer is not needed.

Referring back to the first embodiment of FIGS. 1–6, the impulse generator 12 is controlled by the control system 14, which includes the programmable logic controller 38, the input sensors 40, and the output components 42. The controller 38 receives from the sensors 40 input signals (corresponding to operating parameters of the system 10), analyzes them, and converts the signals into commands for actuating the output components 42 to control the operation of the impulse generator 12.

The controller 38 may be provided by a conventional programmable logic controller, such as that commercially available from Koyo of Conyers, Ga. In addition, the control system 14 may be provided with other conventional control system components known to those skilled in the art. For example, the control system may include a data acquisition module, such as that commercially available from Data Translation of Boston, Mass. And typically a human-machine interface is used, such as that commercially available from Koyo of Conyers, Ga.

For convenience, the input sensors 40 (see FIG. 3) are referred to cumulatively, and each and every one of them is not pointed out in the drawing Figures. The sensors 40 include pressure sensors, temperature sensors, and flow meters. The sensors 40 are selected and configured to monitor the inlet air pressure, the inlet air temperature, the inlet airflow rate, the inlet fuel pressure, the inlet fuel flow rate, the impulse generator surface temperature, the frequency of generated impulses, the amplitude of generated impulses, and the temperature of the fluid leaving the target zone of the boiler. The last input is used to determine the efficiency of the deposit removal process, which is based at least in part on whether superheated steam or hot gases is leaving the target cleaning zone. In a typical commercial embodiment, the pressure sensors are provided by piezoceramic pressure sensors, such as those commercially available from Kistler Instruments of Amherst, N.Y. Also provided is an acoustic measurement system consisting of a 4-channel power supply, such as that commercially available from Kistler Instruments.

For convenience, the output components 42 are referred to cumulatively, and each and every one of them is not pointed out in the drawing figures. The output components 42 include a fuel valve train, an air valve train, and ignitor timing controls. The fuel valve train includes the control valve for controlling the flow of the fuel to the impulse generator as well as safety valves such as a manual shut-off valve, an electric shut-off valve (connected to high and low pressure switches), a check valve (to prevent back pressure), and a vent valve. Similarly, the air valve train includes shut off, check, and vent valves for safety and reliability. The flow of air to the impulse generator is controlled by the control valve and/or by a fan, blower, or the like. Preferably, the electronic shut-off valves are energized continuously when the system is operational and work on an interruptible basis. The fuel and air valves may be provided by solenoid valves that are manually controlled, remotely controlled from a central control room workstation, local control panel, or the like, or both manually and remotely controllable. In a typical commercial embodiment, the valve trains include air and fuel control valves such as those commercially available from Waukee Engineering of Milwaukee, Wis., air and fuel shut-off valves such as those commercially available from ASCO Valve Co. of Florham Park, N.J., and air and fuel pressure switches such as those commercially available from ITT Neo Dyn of Valencia, Calif.

Based on the obtained signals from the sensors 40 at a given time, the control system 14 commands the combustion process to continue and adjusts the frequency and pressure of the generated impulses to maximize efficiency. For example, the control system 14 can respond by increasing or decreasing the air or fuel rate, altering the ignition dwell time (the time period of each spark by the ignitor), and/or altering the ignition interval time (the time period between sparks). In addition, the control system 14 turns off the impulse deposit removal system upon receiving a signal indicating that, for example, the efficiency of the process has been brought back up to a desired level (e.g., a key process parameter such as temperature of steam/water/preheated air in the boiler 16 has increased).

Figure 18:
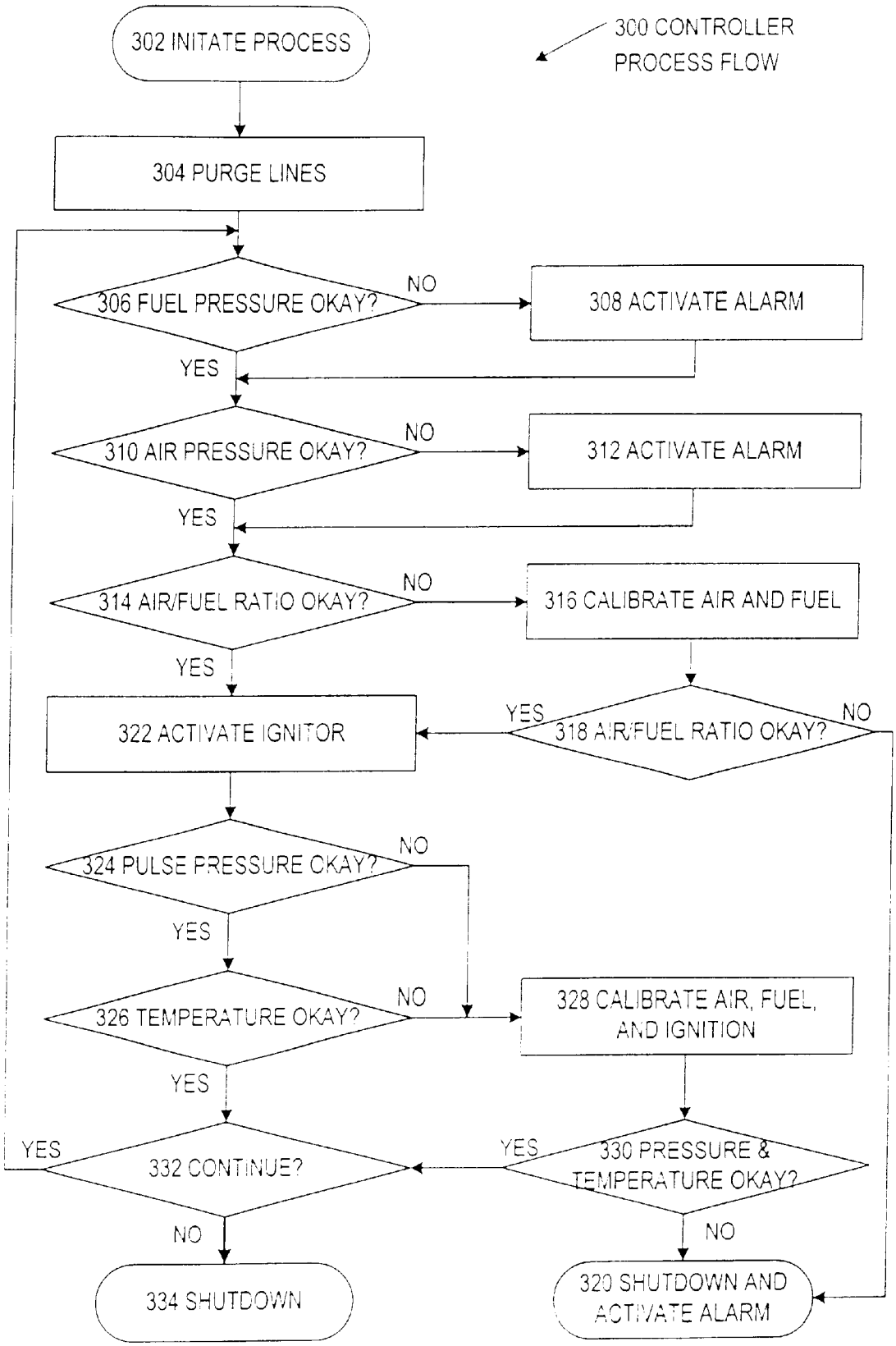
FIG. 18 is a process flow diagram for a controller of the control system of the first embodiment of FIG. 1.

Referring now to FIG. 18 and FIG. 1, the process flow 300 of the controller 38 will be described in more detail. The system 14 is initiated at 302 by turning on the power to the control panel of the control system, after which a safety check of all system parameters is run. Then at 304 a purge cycle comes on that blows out any residual fuel in the lines so that the system 10 is safe for the initial startup. To start the operation, fuel and air are injected into the impulse generator 12 via the appropriate inlets to form a combustible mixture. The fuel pressure is checked at 306, and if the pressure is too high then an alarm sounds at 308. Similarly, the air pressure is checked at 310, and if the pressure is too high then an alarm sounds at 312. Then the air/fuel ratio is checked at 314. If it is not within a predetermined range, then the air/fuel ratio is calibrated at 316 by adjusting the air and fuel control valves and rechecked at 318, and if the ratio is still not within range then the system 14 shuts down and an alarm sounds at 320. If the air/fuel ratio is within limits at 314 or 318, then the ignitor 28 is activated at 322 to ignite the air/fuel mixture.

Figure 2:
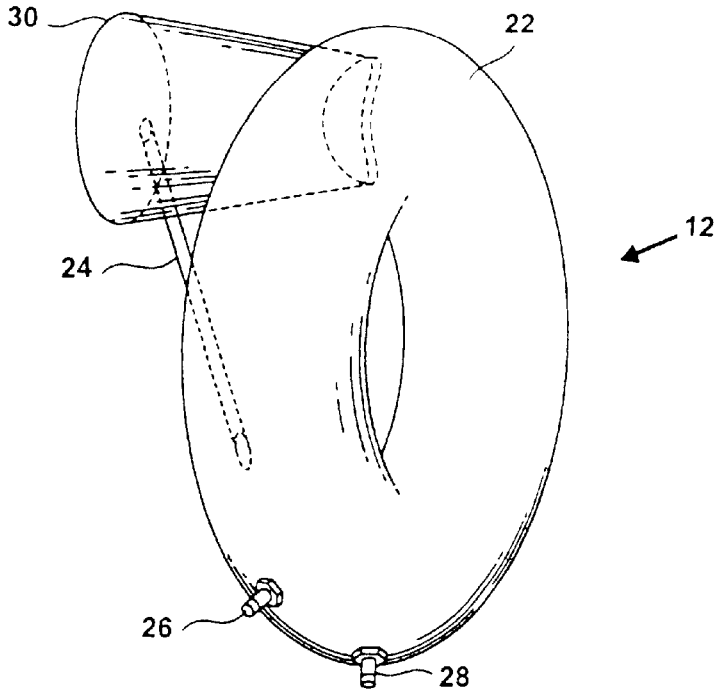
FIG. 2 is a perspective view of one of the impulse generators of FIG. 1, showing a body with an air inlet, a fuel inlet, an ignitor, and an outlet.
Figure 3:
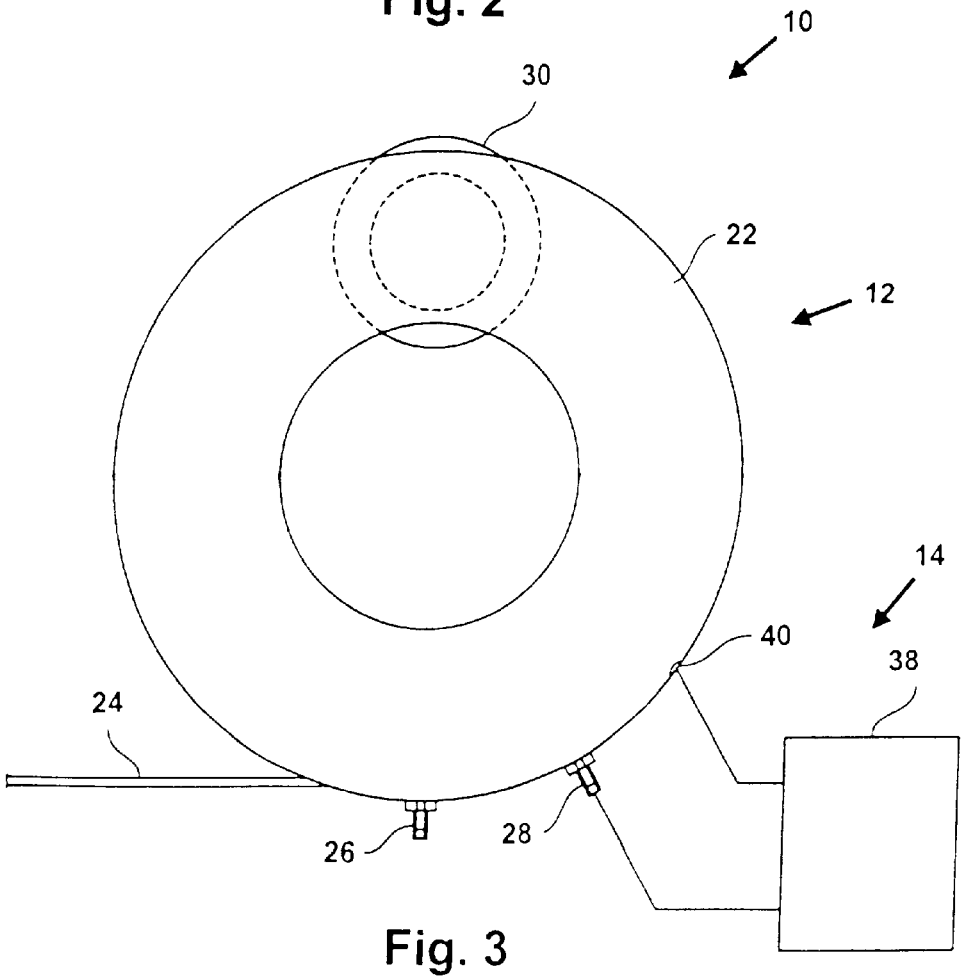
FIG. 3 is a plan view of the impulse generator of FIG. 2.

The ignition and combustion of the air/fuel mixture generate a large and rapid pressure increase within the impulse generator 12, which forces the combustion products out through the outlet 30 and into the boiler 16 where the ash deposits are located (see also FIGS. 2 and 3). Upon generating the initial impulse, the pressure and temperature sensors 40 send signals to the controller 38 indicating the operating parameters of the combustion products. If the pulse pressure is too high at 324 or the pulse temperature too high at 326, then the air flow rate, the fuel flow rate, and the ignition timing are calibrated at 328 and rechecked at 330, and if these values are still not within range then the system 10 shuts down and an alarm sounds at 320.

As long as the pulse pressure and temperature are within acceptance limits, the process may continue by returning to step 306. The process can repeat itself indefinitely as long as fuel and air are supplied.

The initiation at 302 and the shutdown at 334, as well as all other aspects of the operation of the system 10, can be programmed and fully controlled by the control system 14. For example, the control system 14 can be programmed to turn on the deposit removal system 10 at predetermined times such as every eight hours, run for a predetermined time period such as one hour, and then shut down. Or the control system 14 can be programmed to turn on the system 10 upon receiving a signal that the boiler 16 or other technological process has undesirable deposits that need to be removed. The system 10 runs until the efficiency of the boiler 16 has been increased to its predetermined point, then the control system 14 turns off the deposit removal system 10.

Figure 19:
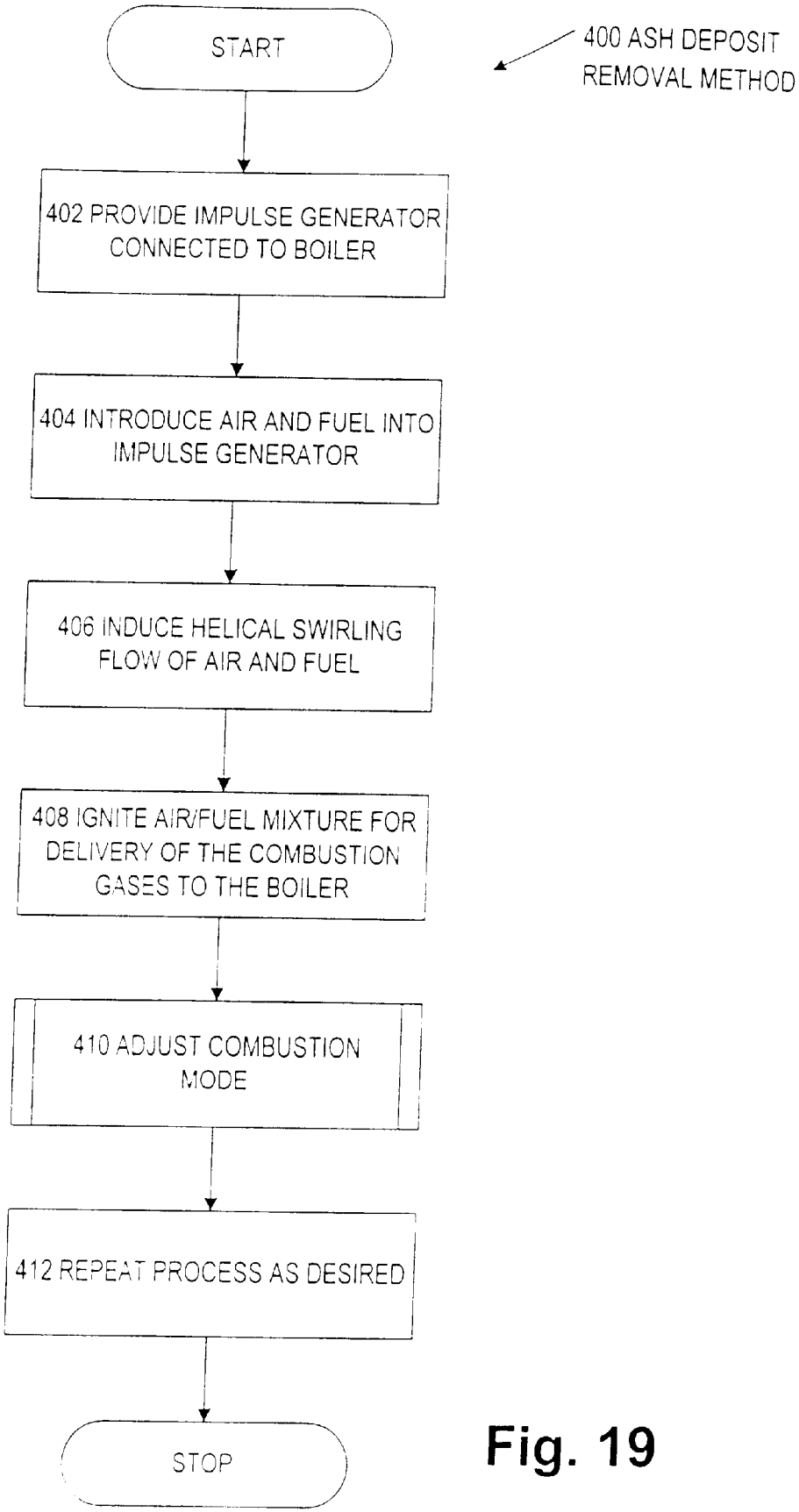
FIG. 19 is a process flow diagram of an exemplary ash deposit removal method according to the present invention.

To this point, the major components of the ash deposit removal system 10 and their general operation have been described. Referring now to FIG. 19, an exemplary method 400 of using this or another impulse generator system to remove ash deposits will now be described.

At 402, at least one impulse generator is provided in communication with the boiler. The impulse generator can be of any type described herein or another type for combusting air and fuel to generate pressure oscillations and waves. At 404, air and fuel are introduced into the impulse generator. The air and fuel can be introduced separately and mixed in the impulse generator or they can be premixed and introduced together. At 406, a helical swirling flow of the fuel and the air in the impulse generator is induced. This can be accomplished by directing the air an fuel around a looped flow path in a toroidal or other shaped impulse generator, by directing the air and fuel over vanes having, for example, a corkscrew shape, by a combination of these, or by other steps. And at 408, the air and the fuel are ignited to produce pressure waves that are transmitted from the impulse generator into the boiler to remove the ash deposits from the boiler. Preferably, the air and the fuel are ignited intermittently to produce controlled pressure waves. It will be understood that steps 402–408 can be provided automatically by the controller, as described above, by another automated control process, or even manually if the application requires it.

At 410, the impulse generator and/or control system components can be adjusted, if desired, to alter the combustion mode for the particular deposits to be removed. Then at 412 the process is repeated, if desired.

Regarding the step 410 of adjusting the combustion mode, the method 400 takes advantage of different combustion characteristics of different combustion modes, including detonative, deflagrative, and pulse combustion. Before getting into the particulars of the combustion mode adjustment step 410, a background discussion of these combustion modes will be presented.

Pulse combustion produces low flame propagation speed and combustion gas pressure, typically in the range of about 20–300 ft/sec and about 0.04–10 psig, respectively. This is a self-sustaining organized combustion process that continues indefinitely as long as fuel and air are supplied. It does not require continuous or intermittent ignition after the process is started. Instead, additional fuel/air is introduced onto the combustor well before the initially ignited fuel/air is completely burned, so that the additional fuel/air is thereby also ignited. This process then continues with additional fuel and air being introduced and ignited, which produces "pulses" of combustion. This type of combustion typically occurs at stochiometric conditions, but some systems can operate on fuel lean conditions. The pulse combustion process generates sound (i.e., standing acoustic wave), typically in the range of about 125–185 dB. Achieving the standing wave is accomplished by using an exhaust pipe on the combustor that is designed based on a sonic wavelength. In addition, some pulse combustors are designed to generate reversible acoustic flame velocities.

Detonative combustion, or detonation, produces extremely high flame propagation speed and combustion gas pressure, typically in the range of about 3,000–12,000 ft/sec. and about 3–300 psig, respectively, for gaseous fuels. Detonative combustion occurs also when the air-fuel mixture is within its explosive limits and it requires intermittent ignition. This type of combustion is essentially a series of individual ignitions, with the combustion process completed before additional fuel and air are introduced for combustion. Therefore, the ignition of the fuel/air produces, almost instantaneously, extremely high combustion-gas pressure increases and oscillations, i.e., shock waves.

Deflagrative combustion, or deflagration, produces medium flame propagation speed and combustion gas pressure, typically in the range of about 100–3,000 ft/sec. and about 3–35 psig, respectively, for gaseous fuels. This is an intermediate combustion mode between pulse and detonative combustion. This combustion process occurs when the explosive limits of the air-fuel mixture are achieved and it requires intermittent ignitions. Deflagrative combustion is an unstable and chaotic process that does not typically have an organized mode. An organized mode, however, can be accomplished by the present invention.

The transition between deflagration and detonation (the "DDT") is hard-to-control. The innovative design of the herein described embodiments of the present invention permit controlling the pressure of oscillations (increase and decrease) and controlling the mode of combustion (deflagration, detonation, or a mix with controllable inclination towards deflagration or towards detonation). This controllability is permitted by the design of impulse generator body (for inducing the helical swirling flow of the fuel and the air and thereby producing complete, uniform, and controllable combustions) and the control system (permitting adjustment of air, fuel and ignition variables). Due to this controllability, the different combustion modes can be selectively used for effectively removing different types of deposits.

Figure 20:
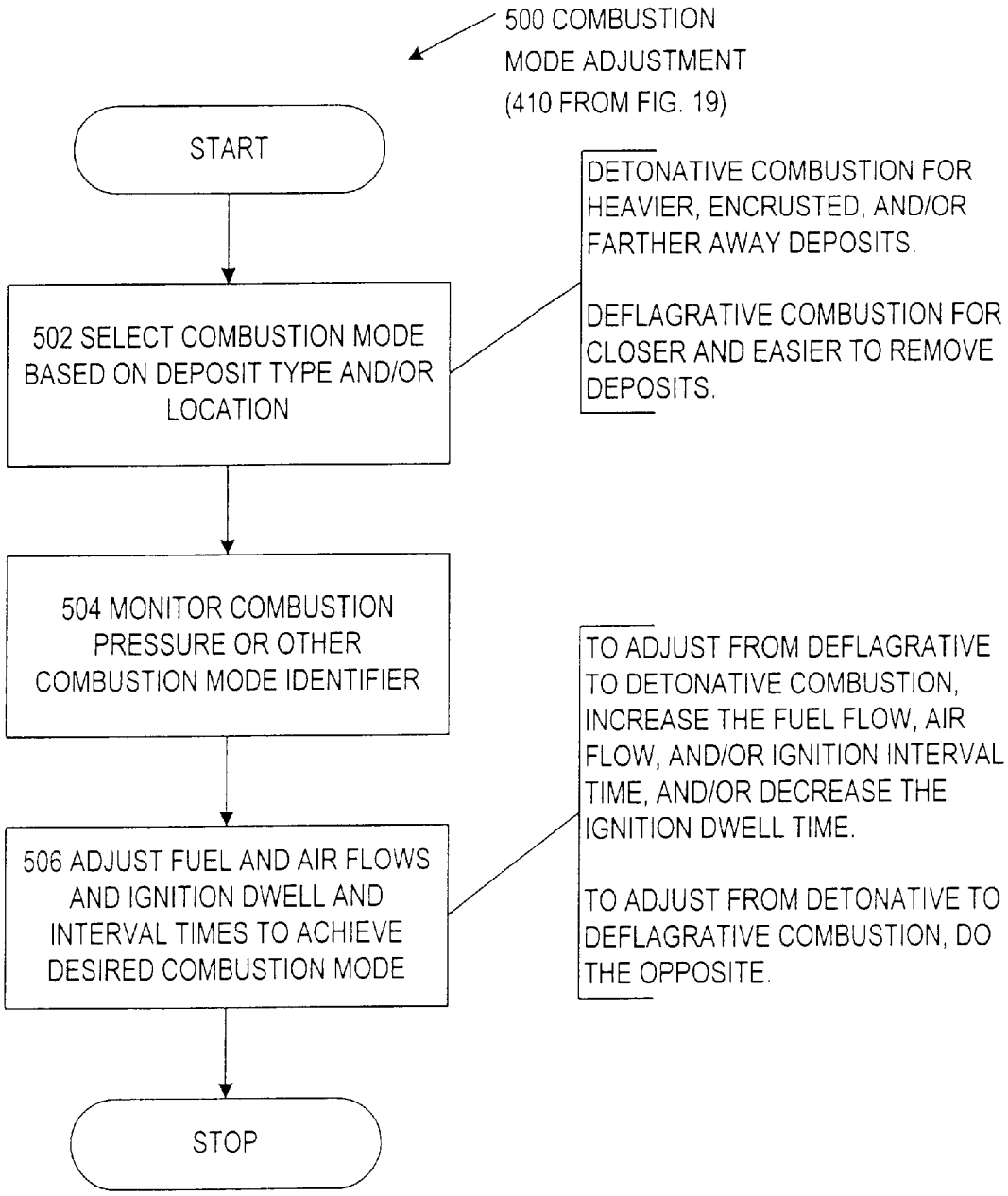
FIG. 20 is a process flow diagram for the process of adjusting the combustion mode of the method of FIG. 19.

Continuing now with FIG. 20, the combustion mode adjustment method 500 (step 410 in FIG. 19) will now be described. The method 500 includes at 502 selecting a desired combustion mode based on deposit type, location, and/or other property. Deposits with different properties are produced and/or formed depending on the type of fuel being burned, the length of accumulation time between operations of the impulse generator, the design and operating parameters (temperature, pressure, etc.) of the boiler or other technological process, etc. For example, for heavier and/or encrusted deposits, and/or for deposits farther away from the outlet of the impulse generator, the detonative combustion mode can be selected because of the higher pressure oscillations produced. For deposits that are closer to the impulse generator and/or are easier to remove, the deflagrative combustion mode can be selected. Because this mode uses less fuel, it is desirable for economical reasons. For deposits with intermediate/combination properties, the combustion mode may be selected in the transition zone between detonative and deflagrative combustion. And for deposits that are very easy to remove and/or that have accumulated on surfaces that are more subject to damage, the pulse combustion mode can be selected for its lower pressure oscillations.

With the impulse generator running, at 504 a combustion mode identifier is monitored. For example, the control system can be configured with the pressure sensors providing signals to the controller corresponding to the pressure of the combustion gases, which correlates to the combustion mode. So by monitoring the combustion pressure, the current combustion mode of the impulse generator can be determined. This step can be the same as and incorporated into steps 324 and 326 of the controller process flow.

Then at 506 the control system output components for the impulse generator are adjusted, if necessary, to adjust the combustion process from the current mode as determined in step 504 to the mode selected in step 502. The adjustments may include adjusting the air flow rate, the fuel flow rate, the ignition dwell time, the ignition interval time, a combination of these, or others. Thus, these adjustments are made by adjusting the air fan and/or control valve, the fuel control valve, and/or the ignitor control. These adjustments can be made manually or automatically by programming the controller for a cycle based on known variances in the type of deposits typically present.

For example, for the ash deposit removal system described above, the detonative mode is achieved with the air flow rate in the range of about 2000–5000 cubic feet per hour, the fuel flow rate in the range of about 100–300 cubic feet per hour, the ignition dwell time in the range of about 0.2–0.03 sec., and the ignition interval time in the range of about 3–5.25 sec. On the other hand, the deflagrative mode is achieved with the air flow rate in the range of about 1000–3000 cubic feet per hour, the fuel flow rate in the range of about 80–130 cubic feet per hour, the ignition dwell time in the range of about 0.35–1.0 sec., and the ignition interval time in the range of about 3–5.25 sec.

Accordingly, to adjust from the deflagrative to the detonative combustion mode, the fuel flow, air flow, and/or ignition interval time is increased and/or the ignition dwell time is decreased. By increasing the ignition interval time, more fuel is kept in the impulse generator at the same inlet flow rate, so the intensity of the combustion is greater. For example, at an ignition interval time of about 5 sec., the air and fuel can be circulated around a looped flow path of a toroidal impulse generator body at about 4 revolutions/sec. In addition, to adjust from the detonative to the deflagrative combustion mode, the fuel flow, air flow, and/or ignition interval time is decreased and/or the ignition dwell time is increased. At relatively slow ignition interval time settings, the air and fuel may not even travel all the way around a tordoidal impulse generator body (depending on its size), so a looped shape may not be needed in some applications.

To provide for precision in these adjustments, the controls for the ignitor preferably have very small increments, for example, 0.01 sec. increments of the ignition dwell and interval time. Precise control of the intensity of the pressure waves provides a smooth transition from one combustion mode to another.

After the control system output components are adjusted, further monitoring of the combustion mode identifier and adjustments of the output components can be made. In this way, the mode of the combustion process can be fine-tuned to produce more precisely the desired pressure oscillations for maximum ash deposit removing effect, thereby maximizing the efficiency of the boiler.

In view of the foregoing, it will be appreciated that present invention provides a way to maintain a generally consistent and relatively high thermal efficiency in boilers by effectively removing ash deposits from heat exchangers. Advantageously, the ash deposit removal system and method of the invention can be used "in-line" while the boiler is being operated. In this way, the heat exchangers can be kept generally free of ash deposit buildup, thereby preventing decreased heat transfer rates and avoiding wasted fuel. And the boiler does not have to be shut down to remove the ash, thereby reducing the operational downtime of the boiler. Furthermore, the system and method of the present invention are operable to induce a helical swirl of air and fuel, intermittently ignite the air/fuel mixture to set up a standing acoustic pressure wave, and direct the pressure wave towards the ash deposits on the heat exchangers. In addition, the ash removal system and method provide for controlling the intermittent ignition to selectively control the detonation and deflagration combustions modes to maximize combustion gas pressures and flame velocities and thus maximize the amount of ash removed. In this way, the ash deposits are time- and cost-effectively removed and kept from building up without shutting down the boiler.

In addition, the present invention provides a number of other advantages over the prior art systems. These advantages include a system that presents a unique way transmitting energy, has extremely short impulse times, and generated waves representing a combination of acoustic, detonative, deflagrative, and combustion fluxes of energy together. Furthermore, the operation of the system can be easily computerized and incorporated into the total control system for the boiler, the troubleshooting process can be performed remotely (i.e., via modem), and the system can be customized to suit specific conditions by changing the general shape, changing the strength of the impulses, or varying the operating parameters.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. In addition, as used in the specification including the appended claims, the singular forms "a," "an," and "the" include the plural, plural forms include the singular, and reference to a particular numerical value includes at least that particular value, unless the context clearly dictates otherwise. Furthermore, any methods described herein are not intended to be limited to the sequence of steps described but can be carried out in other sequences, unless expressly stated otherwise herein.

While certain embodiments are described above with particularity, these should not be construed as limitations on the scope of the invention. It should be understood, therefore, that the foregoing relates only to exemplary embodiments of the present invention, and that numerous changes may be made therein without departing from the spirit and scope of the invention as defined by the following claims.

The invention claimed is:

1. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, wherein the impulse generator is configured to induce a helical swirling flow of the fuel and the air in the impulse generator body; and a control system operable to activate the ignitor to ignite the air and fuel in the impulse generator body to produce pressure waves that are transmitted through the outlet and into the boiler to remove the ash deposits.

2. The impulse system of claim 1, wherein the impulse generator has a curved surface that is configured to induce the helical swirling flow of the fuel and the air.

3. The impulse system of claim 2, wherein the impulse generator further comprises a turbulizer having at least one vane defining the curved surface for inducing the helical swirling flow of the fuel and the air.

4. The impulse system of claim 2, wherein the impulse generator body is toroid-shaped and defines the curved surface for inducing the helical swirling flow of the fuel and the air in the body.

5. The impulse system of claim 2, wherein the curved surface is disposed within the impulse generator body.

6. The impulse system of claim 1, wherein the air inlet and the fuel inlet deliver the air and the fuel separately into the impulse generator body for mixing therein.

7. The impulse system of claim 1, wherein the control system is operable to intermittently activate the ignitor to intermittently ignite the air and fuel in the impulse generator to intermittently produce the pressure waves.

8. The impulse system of claim 1, wherein the control system includes at least one valve for controlling flow of the fuel and the air to the impulse generator, and the control system is operable to adjust the fuel flow, the air flow, dwell time of the ignitor, or a combination thereof to produce deflagrative or detonative combustion in the impulse generator.

9. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, wherein the impulse generator body has a curved surface and the air inlet is generally tangential to the curved surface for inducing a helical swirling flow of the fuel and the air in the body; and a control system operable to activate the ignitor to ignite the air and fuel in the impulse generator body to produce pressure waves that are transmitted through the outlet and into the boiler to remove the ash deposits.

10. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, wherein the impulse generator body is toroidal-shaped for inducing a helical swirling flow of the fuel and the air therein; and a control system operable to activate the ignitor to ignite the air and fuel in the impulse generator body to produce pressure waves that are transmitted through the outlet and into the boiler to remove the ash deposits.

11. The impulse system of claim 10, wherein the air inlet is generally tangential to a side view cross section of the body for inducing a helical swirling flow of the fuel and the air in the body.

12. The impulse system of claim 11, wherein the air inlet is at an acute angle to a plan view flow path centerline of the body for inducing a helical swirling flow of the fuel and the air in the body.

13. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, wherein the impulse generator body is toroidal-shaped and the air inlet is generally tangential to a plan view flow path centerline of the body for inducing the fuel and the air to flow in a loop within the body; and a control system operable to activate the ignitor to ignite the air and fuel in the impulse generator body to produce pressure waves that are transmitted through the outlet and into the boiler to remove the ash deposits.

14. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, and wherein the impulse generator further comprises a turbulizer having at least one generally corkscrew-shaped vane disposed within the hollow body for inducing a helical swirling flow of the fuel and the air in the body; and a control system operable to activate the ignitor to ignite the air and fuel in the impulse generator body to produce pressure waves that are transmitted through the outlet and into the boiler to remove the ash deposits.

15. The impulse system of claim 14, wherein the turbulizer further comprises a conduit extending into the body and having one or more apertures defined therein, wherein the corkscrew-shaped vane extends outwardly from the conduit, and the fuel or air flows through the conduit, through the apertures, and into the body.

16. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler, and wherein the air inlet and the fuel inlet comprise a combined air/fuel inlet for delivering an air/fuel mixture into the impulse generator body; and a control system operable to activate the ignitor to ignite the air and fuel in the impulse generator body to produce pressure waves that are transmitted through the outlet and into the boiler to remove the ash deposits.

17. An impulse system for removing ash deposits from a boiler, comprising:

at least one impulse generator having a hollow body with an inlet for air, an inlet for fuel, and an outlet for ignited air and fuel, and having an ignitor coupled to the body, wherein the outlet is in communication with the boiler; and a control system operable to activate the ignitor to ignite the air and fuel in the impulse generator body to produce pressure waves that are transmitted through the outlet and into the boiler to remove the ash deposits, wherein the boiler includes at least one heat exchanger and the impulse generator is connected to the boiler adjacent the heat exchanger for directing the pressure waves at the heat exchanger.

18. An impulse system for removing ash deposits from at least one heat exchanger of a boiler, comprising:

at least one impulse generator having a toroidal-shaped hollow body with an inlet for air, an inlet for fuel, and an outlet for ignited air and fuel, and having an ignitor coupled to the body, wherein the air inlet is generally tangential or at an acute angle to a plan view flow path centerline of the body and the air inlet is generally tangential to a side view cross section of the body for inducing the fuel and the air to flow in a loop within the body while inducing a helical swirling flow of the fuel and the air in the body, and the outlet is in communication with the boiler; and a control system operable to intermittently activate the ignitor to intermittently ignite the air and fuel in the impulse generator body to intermittently produce pressure waves that are transmitted through the outlet and into the boiler to remove the ash deposits from the boiler heat exchanger.

19. The impulse system of claim 18, wherein the outlet is disposed perpendicularly to a side view centerline of the impulse generator body.

20. The impulse system of claim 18, wherein the outlet is disposed tangentially to the impulse generator body and in an opposite direction from the helical swirling flow of the fuel and the air.

21. The impulse system of claim 18, wherein the outlet is flared.

22. The impulse system of claim 18, wherein the outlet is valveless.

23. The impulse system of claim 18, wherein the control system includes at least one valve for controlling flow of the fuel and the air to the impulse generator, and the control system is operable to adjust the fuel flow, the air flow, dwell time of the ignitor, or a combination thereof to produce deflagrative or detonative combustion in the impulse generator.

24. An impulse system for removing ash deposits from at least one heat exchanger of a boiler, comprising:

at least one impulse generator having a hollow body with an inlet for air, an inlet for fuel, and an outlet for ignited air and fuel, a turbulizer including at least one generally corkscrew-shaped vane disposed within the hollow body for inducing the helical swirling flow of the fuel and the air in the body, and an ignitor coupled to the body, wherein the outlet is in communication with the boiler; and a control system operable to intermittently activate the ignitor to intermittently ignite the air and fuel in the impulse generator body to intermittently produce pressure waves that are transmitted through the outlet and into the boiler to remove the ash deposits from the boiler heat exchanger.

25. The impulse system of claim 24, wherein the fuel inlet comprises a fuel conduit that extends into the body and has one or more apertures defined therein, the corkscrew-shaped vane extends outwardly from the fuel conduit, and the fuel flows through the fuel conduit, through the apertures, and into the body.

26. The impulse system of claim 25, wherein the fuel conduit is disposed coaxially within the air inlet.

27. The impulse system of claim 24, wherein the hollow body is generally cylindrical.

28. The impulse system of claim 24, wherein the control system includes at least one valve for controlling flow of the fuel and the air to the impulse generator, and the control system is operable to adjust the fuel flow, the air flow, dwell time of the ignitor, or a combination thereof to produce deflagrative or detonative combustion in the impulse generator.

29. A method for removing ash deposits from a boiler, comprising:

providing at least one impulse generator in communication with the boiler;

introducing air and fuel into the impulse generator;

inducing a helical swirling flow of the fuel and the air in the impulse generator; and igniting the air and the fuel to produce pressure waves that are transmitted from the impulse generator into the boiler to remove the ash deposits from the boiler.

30. The method of claim 29, further comprising intermittently igniting the air and the fuel to intermittently produce the pressure waves.

31. The method of claim 29, further comprising providing a control system operably connected to the impulse generator, wherein the control system carries out the steps of introducing and igniting the air and fuel.

32. A method for removing ash deposits from a boiler, comprising:

providing at least one impulse generator in communication with the boiler, the impulse generator comprising a toroidal-shaped body, a turbulizer with at least one cork-screw-shaped vane, or a combination thereof, configured for inducing a helical swirling flow of the fuel and the air;

introducing air and fuel into the impulse generator;

inducing a helical swirling flow of the fuel and the air in the impulse generator; and igniting the air and the fuel to produce pressure waves that are transmitted from the impulse generator into the boiler to remove the ash deposits from the boiler.

33. A method for removing ash deposits from a boiler, comprising:

providing at least one impulse generator in communication with the boiler;

selecting a combustion mode for impulse generator based on properties of the ash deposit;

introducing air and fuel into the impulse generator; and igniting the air and the fuel to produce pressure waves that are transmitted from the impulse generator into the boiler to remove the ash deposits from the boiler.

34. The method of claim 33, further comprising inducing a helical swirling flow of the fuel and the air in the impulse generator.

35. The method of claim 33, wherein the step of selecting the combustion mode includes selecting a detonative or deflagrative combustion mode.

36. The method of claim 33, further comprising adjusting fuel flow, air flow, ignition dwell time, or a combination thereof, to achieve the selected combustion mode.

* * * * *